United States Patent [19]

Del Castillo von Haucke

[11] Patent Number: 4,807,539

[45] Date of Patent: Feb. 28, 1989

[54] MULTI-STATION MODULAR OFFICE FURNITURE

[76] Inventor: Juan M. Del Castillo von Haucke, Salamanca 34, 2° Piso, Mexico City, D.F., Mexico

[21] Appl. No.: 189,017

[22] Filed: May 2, 1988

Related U.S. Application Data

[63] Continuation of Ser. No. 53,473, May 26, 1987, abandoned.

[30] Foreign Application Priority Data

Jun. 4, 1986 [MX] Mexico ..... 2698
Sep. 4, 1986 [MX] Mexico ..... 3656

[51] Int. Cl.[4] ..... A47B 57/00
[52] U.S. Cl. ..... 108/111; 312/257 R
[58] Field of Search ..... 108/111, 108; 211/186; 312/263, 257 R, 223, 195

[56] References Cited

U.S. PATENT DOCUMENTS

| | | | |
|---|---|---|---|
| 1,700,202 | 1/1929 | Langford | 312/195 |
| 2,908,400 | 10/1959 | Richter | 108/111 X |
| 3,069,216 | 12/1962 | Vaeth | 312/195 |
| 4,056,897 | 11/1977 | Pearce et al. | 108/111 X |
| 4,153,311 | 5/1979 | Takahashi | 108/111 X |
| 4,463,997 | 8/1984 | Densen | 312/257 R X |
| 4,560,215 | 12/1985 | Turner | 312/195 X |
| 4,582,002 | 4/1986 | Wright | 108/111 |

FOREIGN PATENT DOCUMENTS

| | | | |
|---|---|---|---|
| 7911680 | 11/1980 | France | 108/111 |

*Primary Examiner*—Kenneth J. Dorner
*Assistant Examiner*—José V. Chen
*Attorney, Agent, or Firm*—Karl W. Flocks

[57] ABSTRACT

Multiple station modular office furniture including a primary table top partitioned to be shared privately by four users and coordinated with two lateral table tops partitioned to be shared by said four users so that each user has a primary table portion and a lateral table portion, vertical panels assembled with said tops utilizing slots in said panels and tops to provide a balanced, stable, strong structure.

2 Claims, 6 Drawing Sheets

MULTI-STATION MODULAR OFFICE FURNITURE

This application is a continuation of parent application U.S. Ser. No. 053,473, filed May 26, 1987, now abandoned originally entitled "Modular Furniture" and claiming priority based on my Mexican Application No. 2698 filed June 4, 1986, entitled "Mueble Modular Para Oficina", and on my Mexican Application No. 3656 filed Sept. 4, 1986, entitled "Mejoras En Mueble Modular".

The present invention is related to an innovative modular office, reception, and industry furniture, structured on the basis of multiple sections which are assembled using slots and ridges, to integrate a modular furniture which consists of four working areas, with filing cabinets, bookshelves and individual lateral tables or to integrate a whole piece comprising two individual modules which include a desk, a filing cabinet and a table which is shared by both modules.

Due to the innovative structure, form, assembly, and functional features of the individual sections, the modular office furniture now provided and the modular furniture with a shared table for the two individual modules are considered notable developments in this field.

BACKGROUND TO THE INVENTION

In the field of industrial activity of the manufacture of office furniture, the typical desk is well known and these are manufactured in a great variety of designs basically consisting of a horizontal desktop, held by several legs, generally four, with or without drawers in some designs, with a horizontal work area including integrated or detachable shelves.

On the other hand, recently, modular office furniture is being designed, which commonly comprises one or more working tables, separated by vertical dividers which can be adjusted and removed. These modules are built with the purpose of occupying the least possible space to be used by the greatest number of persons possible. In many offices, the area allocated for the working furniture of the personnel is generally restricted, thus it becomes necessary to use small desks or small modules, individually adjustable, to accommodate the greatest number of persons possible. The known modules have solved part of that problem, but have the disadvantage of being uncomfortable or very expensive, since in its manufacture not only wood is used, but also other materials such as steel, aluminum and even plastics.

Another disadvantage of the conventional modules is that its assembly is labour intensive since generally they are heavy or difficult to adjust, requiring qualified laborers and considerable time in the operations of assembly and removal. Besides, in the majority of the cases, the modules do not satisfactorily solve the problem of little available space, since the area they occupy is considerable and on their account it becomes necessary to sacrifice comfort and functional considerations if the intent is to place a great number of modules in a limited space.

Moreover, frequently, it is necessary to address specific problems that also result from specific activities, such as those of the receptionist of an office or industry, and for this type of activity generally there is no appropriate modular furniture. Of course, the most commonly used ones can be employed, or a simple desk, but these do not solve the problem adequately.

With the innovative modular furniture now claimed, the previously exposed problems are satisfactorily solved since it offers significant advantages; it can be used for reception tasks in offices or industries; it occupies little space; exhibits the maximum utilization of a common table shared by two individual modules; it is built with a minimum of sections; its cost is low and is built with just one material, although eventually other materials can be used in its manufacture; it is light, easy to transport and can be assembled and removed easily without the need of qualified laborers.

SUMMARY OF THE INVENTION

The present invention is related to a modular office furniture, consisting of several pre-cut panels which are assembled through the use of joined slots to define the individual working modules, separated one from another.

The assembly through the use of "joined slots" as above stated is sometimes recited as the use of "slots and ridges". In the lexicography of this specification it is to be understood that "joined slots" and assembly "using slots and ridges" express the same meaning. In other known constructions joints include "mortise and tenon", "tongue and groove", and "male member and female member". In the construction recited herein and illustrated in the drawings, the slots of two different panel members are joined in such a way that one of the slots acts as a female member and the two opposite plane surfaces of a second panel member, which may also be slotted, acts as a male member. In this sense the joining of the two slots results in an assembly corresponding to an assembly of a female member and a male member.

The panels are built with just one material and artificial light fixtures can be adapted for evening work.

It is thus one of the objects of the present invention, a modular office furniture of innovative design, consisting of multiple panels assembled using slots found in determined places of its surfaces.

Another objective is that the modular office furniture is light, easy to assemble, remove and transport.

Another objective is that the modular furniture provides the maximum utilization of its work areas, within a minimum use of space.

Another objective is that the modular furniture offers greater functional features than the conventional modules or desks.

Still another objective is that the modular furniture presents structural characteristics which make it appropriate for its utilization in the reception areas of offices and industries.

The previous and other objectives of the invention will be evidenced with greater clarity and detail in the following chapter of the description of the patent.

DETAILED DESCRIPTION OF THE INVENTION

In order to acquire clear and complete knowledge of how the modular office furniture of the present invention is structured, reference will be made to the drawings, of which:

Figure 1:
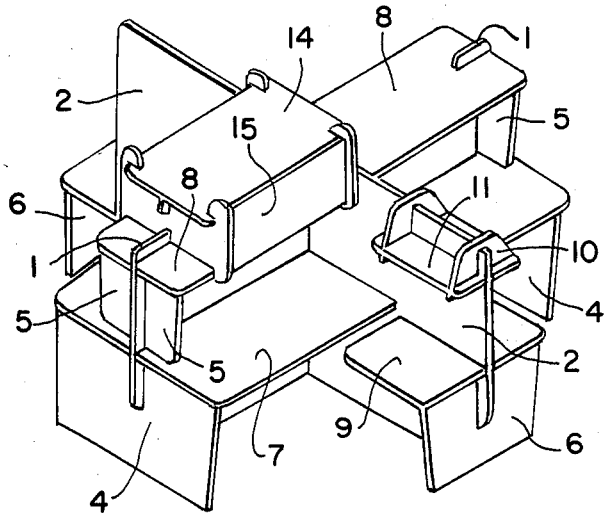
FIG. 1 is a perspective view of the modular office furniture, arranged generally in a cross and provided with filing cabinet, bookshelves and lateral table.
Figures 2, 4:
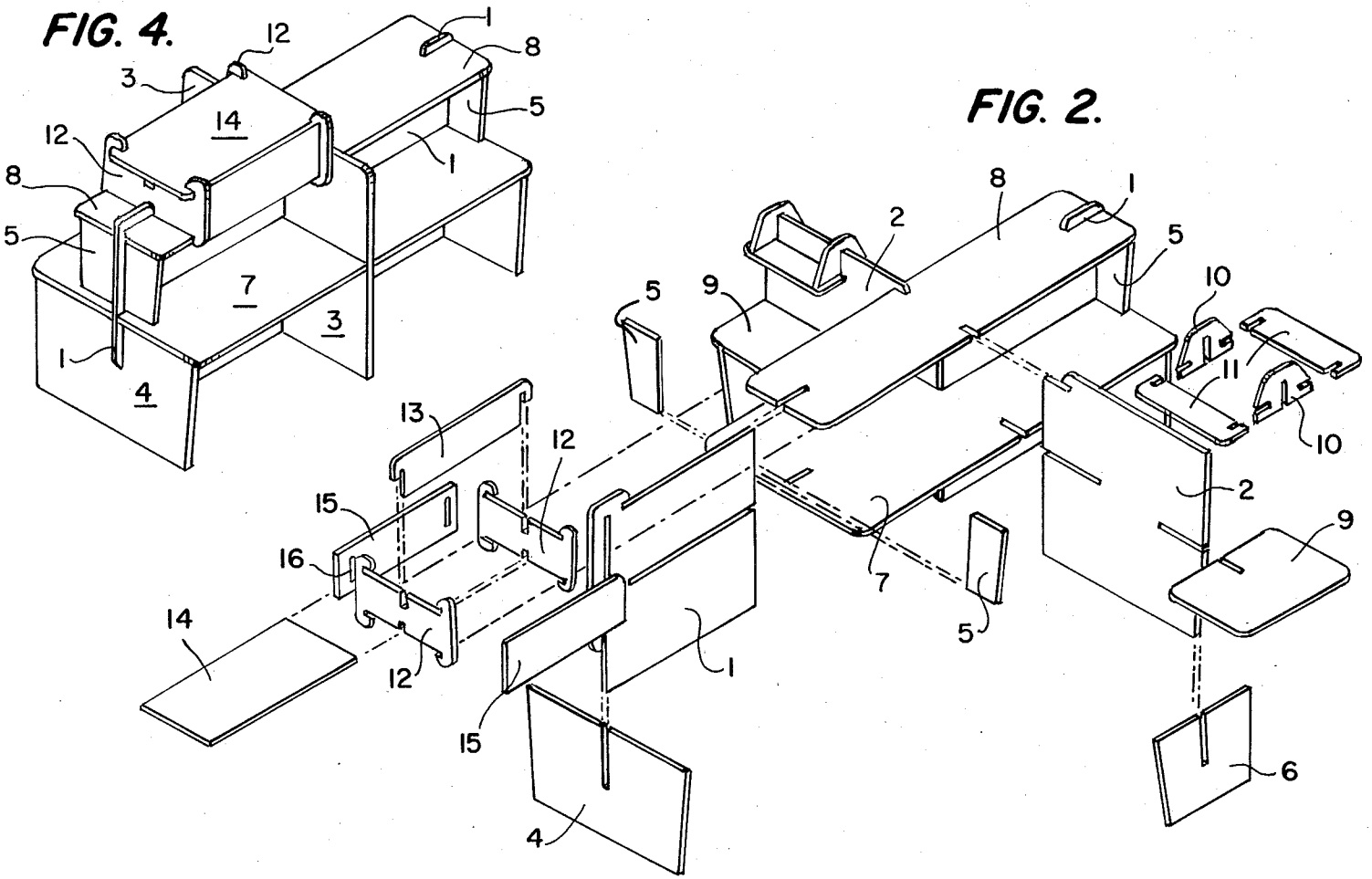
FIG. 2 is an exploded perspective of the modular furniture shown in FIG. 1.
FIG. 4 is a perspective of the modular office furniture in a rectangular arrangement and provided with a double filing cabinet.

As presented in the drawings, the modular office furniture consists of various panels which are assembled through a system of slots and ridges. Referring to FIG. 1, the vertical and horizontal panels are shown in their assembled positions and in FIG. 2 is shown in a very clear manner the sectional components of the furniture, given that the panels in FIGS. 1 and 2 are the same, reference is made to both Figures. For ease of and greater understanding, the vertical panels are mentioned first, followed by the horizontal ones of the main parts of the furniture and finally the panels which constitute the document storage unit such as the filing cabinet and the bookshelves. In this Specification the term "document storage unit" is generic to "filing cabinet" and "bookshelves". The two lower panels 4, each with a vertical slot, at the right and left sides of the furniture, are assembled with the corresponding protruding ridges of panel 1. There are four panels 5 which constitute the furthest right and left superior edges of the furniture, these panels do not have slots or ridges and to assemble they are inserted in the slot of the upper edge of panel 1, in such a fashion that they face each other. Two panels 2 are part of the principal divider of the four working areas in a cross arrangement of the modular furniture. Panels 2 have two horizontal slots which meet and two ridges in two different sides of the panel. The two panels 2, when they are assembled, join and each rests in the corresponding slot of the panel in the horizontal panel 7 and the horizontal panel 8. Panels 6, in pairs, constitute the other two edges of the furniture and when assembled they are joined with the corresponding ridges of panels 2. Panels 6 each have only one vertical slot. The other leading divider of the furniture that enables the appearance of the four working areas, is constituted by two panels 1 and, as mentioned previously, they help define the four working areas of the modular furniture. These panels 1 have a horizontal slot, two ridges in two different sides of the panel. The two panels 1, when assembled, join through the horizontal slot of panel 7 and the horizontal slot of panel 8, thus coming together.

The horizontal panels 7, 8, and 9 are comprised in the modular office furniture. Panel 7 has four slots, one in each of the four sides of the panel. Panel 7 is properly the working table of the furniture. Panel 8, with four slots, one in each of the four sides of the panel, constitutes the upper surface of the furniture. Panels which fit into the slots of panels 7 and 8 have been mentioned previously. Panel 9 has a slot which, when assembled, rests in the corresponding vertical slot of panel 2. Panel 9 which constitutes the lateral working table is joined with panel 2 so that each panel 9 constitutes the lateral working table for two areas.

As illustrated in FIG. 1, the horizontal panel 7 is separated into at least two working table portions by the vertical partition panel member 2. Also illustrated in FIG. 1 the horizontal panel 9 which extends in a lateral direction from horizontal panel 7 is also separated into two table portions by vertical partitioning panel member 2. Further as illustrated in FIG. 1 the vertical panel member 6 supports a margin of the laterally extending horizontal panel 9. It is to be understood that the term "lateral" and expression "extending generally laterally" means "to one side in the relation that one leg of a right angle bears to the second leg of said right angle. As illustrated in FIG. 1, wherein the horizontal panel 9 constitutes the lateral working table for two areas, it may be observed that the defined space between a free edge of the horizontal panel 7 and the adjacent free edge of the generally laterally extending panel 9 provide a space for a user of portions of panels 7 and 9 as a work station. Thus it will be understood that this lateral arrangement positively positions and defines the angular space for the user of a work station.

Referring to the drawings including particularly FIGS. 1 and 2, it will be understood that the structure provides for a plurality of panels including horizontal table portions and vertical panel members formed with one or more slots and assembled with one another by means of said slots which cooperate with surfaces of said panels to effect the joining and interconnecting of said panels into a stable, strong and balanced structure.

Panels 12, 13, 14, and 15 constitute the filing cabinet of the modular office furniture. Panel 12, see FIG. 2, has two slots and four ridges, two lower and two upper. The two panels 12 through their lower ridges allow for these to rest on the upper surface of panel 8. Panel 13, see FIG. 2, has two ridges, one in each side and, when assembled, the ridges rest in the upper slots of panel 12. Panel 13 properly defines two spaces in the filing cabinet for each working area of the modular office furniture in such a manner that there can be filing cabinets for two working areas or all four which comprise the furniture. Panel 14 which has no slots or ridges, rests over the upper ridges of the two panels 12. Panel 14 once assembled becomes the upper part of the filing cabinet. Panel 15 which has no slots or ridges, in pairs, form part of the door of each of the two sections of the filing cabinet and joins the edges of panels 12 through a system of sliding hinges.

The bookshelves of the modular office furniture comprise panels 10 and 11. Panel 10 has a slot in one of its sides and two perpendicular slots to the aforesaid slot in another two sides. Panel 10 in pairs rests through one of its slots in the upper edge of panel 2. The two panels 10 constitute the lateral walls of the bookshelves. Panel 11 in pairs, has two parallel slots next to each one of its ends, which, when assembled, rest in the corresponding two slots of panel 10. Panel 11 constitutes the base of the two sections of the bookshelves for each working area of the furniture, so that there can be bookshelves in two or all four working areas of the furniture, in which case four panels 10 are needed and four panels 11.

Figure 3:
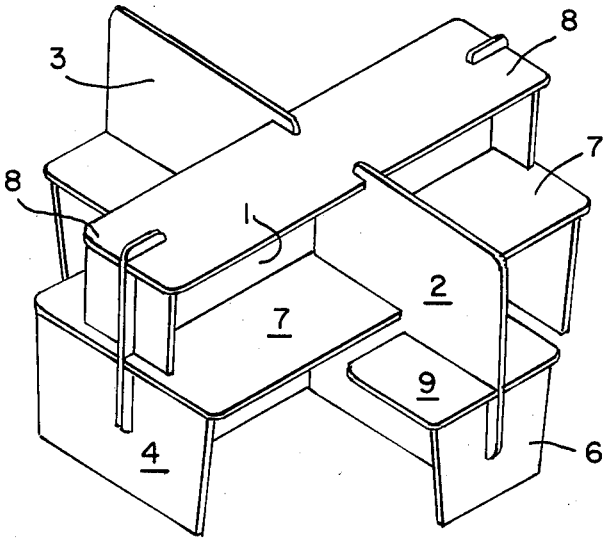
FIG. 3 illustrates a perspective view of the modular office furniture, provided with a lateral table, in a cross arrangement, without filing cabinet and bookshelves.

FIG. 3 shows modular office furniture where the reference numbers have the same significance to those given to FIGS. 1 and 2. In FIG. 3, the furniture is shown without the filing cabinet or the bookshelves which are shown in FIG. 1 or 2, the previous one as an example of the possibility to incorporate accessory components or complementary parts to a main structure.

The three figures previously described correspond to the cross arrangement of the modular office furniture with four working areas. Next, with the help of FIGS. 4, 5, and 6, will be described another form of the modular office furniture which corresponds to a rectangular arrangement with four working areas.

FIG. 4 shows a perspective view of the modular office furniture consisting of two panels 4 which form the lower portion of the unit.

Figure 5:
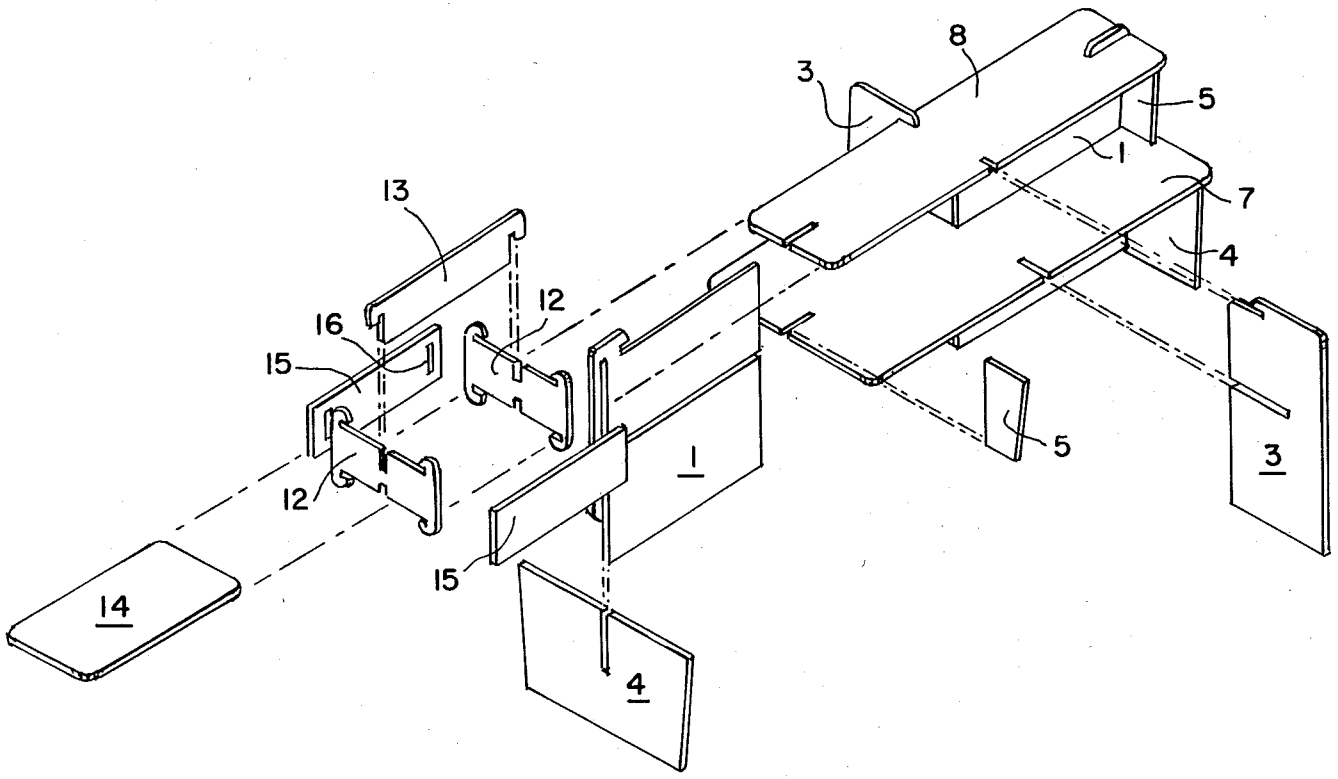
FIG. 5 is an exploded perspective of the modular furniture shown in FIG. 4.
Figure 6:
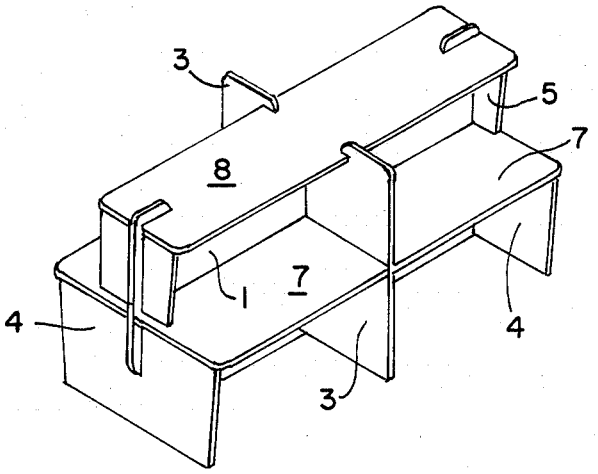
FIG. 6 is a perspective of the modular office furniture in a rectangular arrangement, without filing cabinet.
Figure 7:
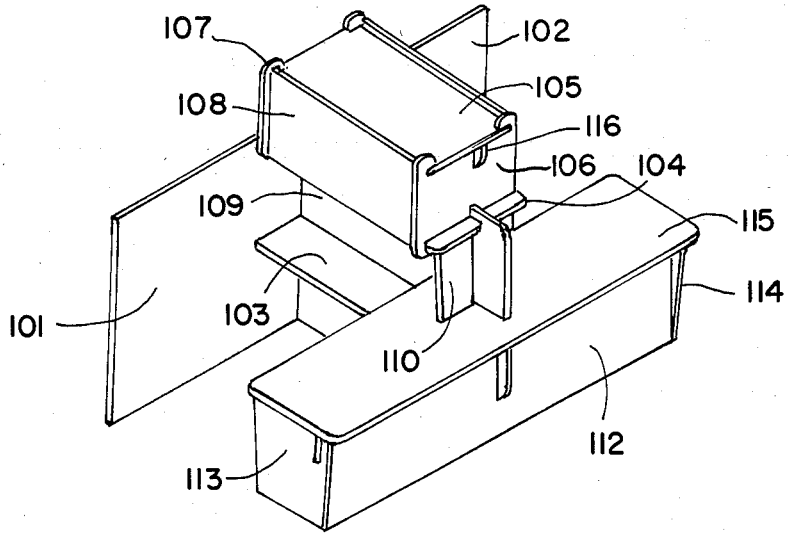
FIG. 7 is a perspective view of another form of modular furniture.
Figure 8:
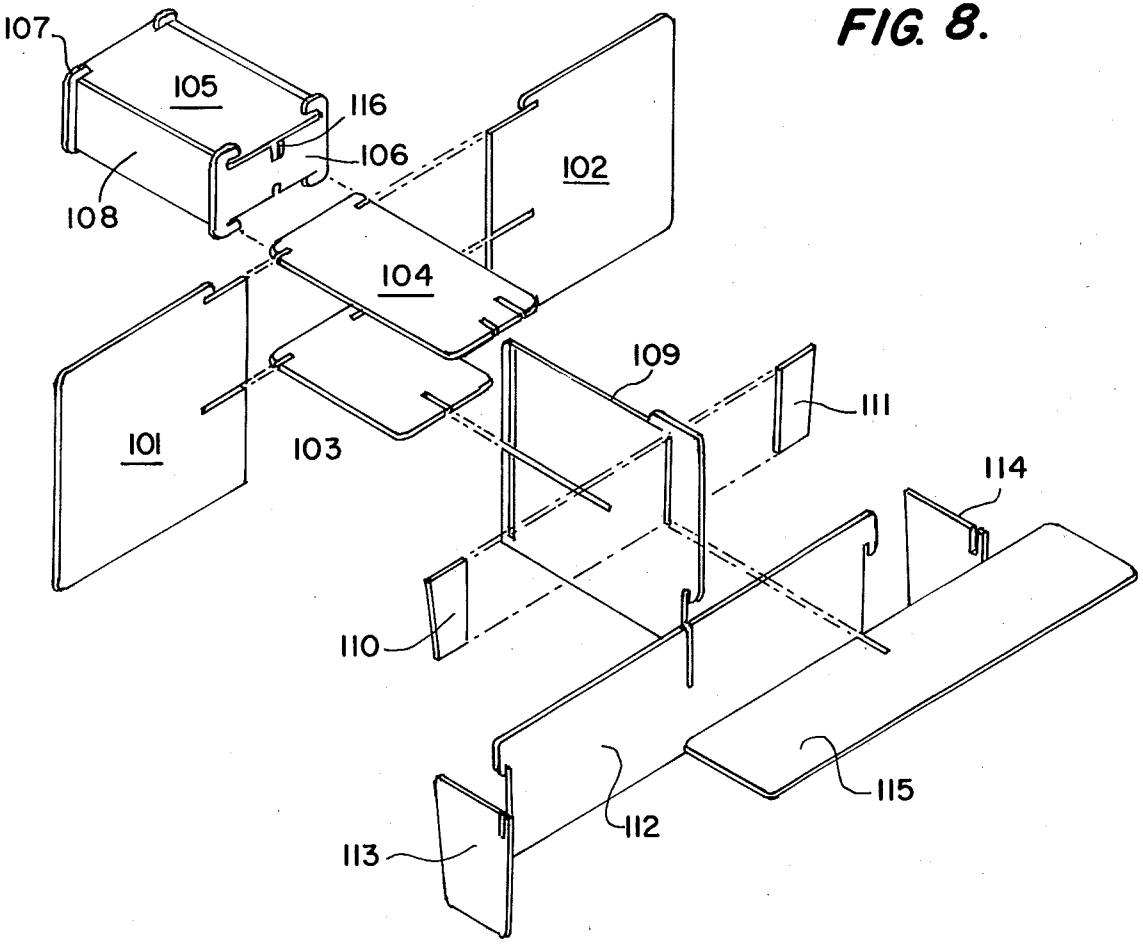
FIG. 8 is an exploded perspective of the modular furniture in FIG. 7.
Figure 9:
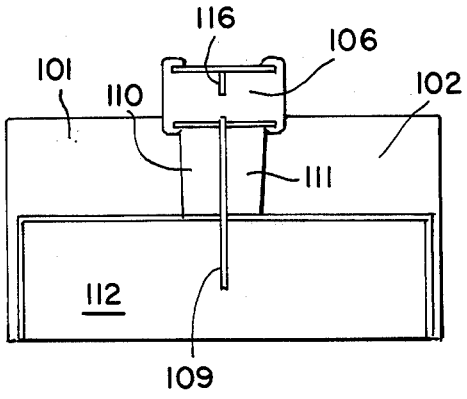
FIG. 9 is a front view of the common table for the two modules, illustrated in FIG. 7.
Figure 10:
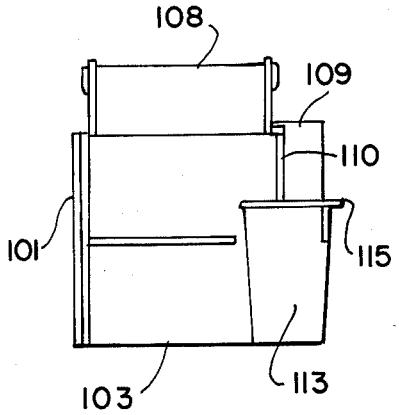
FIG. 10 is a front view of one of the individual modules and, finally.
Figure 11:
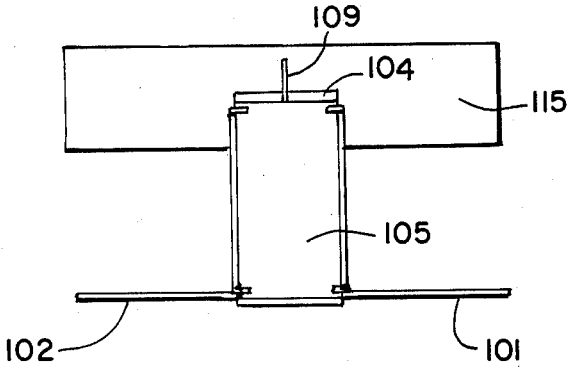
FIG. 11 is a top plan view of the form of modular furniture of the present invention, as illustrated in FIG. 7.

All the panels mentioned for the FIGS. 4, 5, and 6, except 3, have the same reference numbers and what is more important, the same structural characteristics, as well as the same type of assembly as those mentioned for FIGS. 1 to 3.

Panels 4, are assembled with the corresponding protruding ridges of panel 1. Panels 5, in sets of 4, constitute the two upper portion of the furniture, and they fit in the corresponding slot of panel 1. Panel 3, provided in pairs, constitutes the principal divider of the modular furniture and has a horizontal slot and also a protruding ridge parallel to the slot in the upper edge. Panel 3, when assembled, fits through the slot in the corresponding slot of panel 8. Panel 1, provided in pairs, constitutes the other principal divider of the modular furniture, and, when assembled, fits into the corresponding slots of panels 7 and 8. The horizontal panel 7 constitutes the working table for the four working areas and through its four slots it joins with panels 2 and 3 and two panels 1. The horizontal panel 8 constitutes the upper surface of the modular furniture, and its four slots join with two panels 1 and two panels 3.

The filing cabinet for this style of the modular furniture is built in the same manner as in the arrangement for FIGS. 1 and 3, with panels 12, 13, 14, and 15, which are assembled in the same fashion, and with sliding hinges 16.

FIG. 5 is an exploded perspective of the embodiment in FIG. 4 and its parts have already been described in detail. FIG. 6 shows the modular furniture in a rectangular arrangement but without the filing cabinet which appears in FIGS. 4 and 5, which means that the filing cabinet is optional, depending upon the needs of the user, and, of course, the reference numbers in the FIG. 6 have the same significance as those given for the FIGS. 4 and 5.

The modular furniture consists of various panels depicted in FIGS. 7, 8, 9, 10, and 11. Panels 101 and 102, being of the same design, that is, squares, which are held in a vertical position in the furniture, with a horizontal slot at approximately half height, as well as a slot in the upper portion of the panel which also defines a parallel addition to and in the same place where the slot at mid height previously mentioned is found. Each of these panels when assembled is joined by one of its sides, inserted in the horizontal slots of the two horizontal panels 103 and 104, these panels, a lower and an upper, are rectangular and have slots close to one end and parallel to one of the shorter sides of the rectangle. The panels 101 and 102 through their mid level slot are assembled with the respective ones of the lower panel 103 and with its upper protruding ridge, are assembled with the respective slots of the upper panel 104. In this manner the panels 101 and 102 are assembled into one of the sides of the individual modules, or, from another angle, the back panel of the furniture. The lower horizontal panel 103 constitutes the working area of both individual modules which comprise the furniture, while the horizontal upper panel 104 is the base over which the filing cabinet rests. The filing cabinet within the modular furniture is built with a horizontal upper panel 105, two vertical lateral panels 106 and 107, as well as two doors made up of sliding panels 108. The panels 106 and 107 have four protruding ridges, one in each corner, so that by assembling the upper panel 105, which slides between the two protruding ridges of the panel 106 so it fits into the respective two slots of the panel 107. The same happens with the base of the filing cabinet made up by the panel 104 in accordance with the structure of the filing cabinet, which is common for the the two individual modules and thus divided internally in two sections by a rectangular panel with two protruding ridges, one in each side 116. The ends of the panels 103 and 104 opposite to where the previously mentioned two protruding ridges are found, has a slot perpendicular to the previous two. In other words, that slot is parallel to the longer sides of these rectangular panels.

In the perpendicular slot of the lower horizontal panel 103 will be placed panel 109, the panel held in a vertical position in the modular furniture, a square, and with several protruding ridges, has a primary horizontal slot which is one used to assemble panel 103. Panel 102 is associated with big vertical slots parallel to one of the ends of the panel 109 that are co-linear upper and lower slots. In these slots are assembled the edges of one side of the panels 101 and 102. Panel 109 has a third vertical slot close to the opposite side of the two co-linear slots. In the third slot are inserted two vertical panels 110 and 111 which have two of their sides parallel and of the two other sides one is straight and vertical and the other is slanted. Panel 109 properly constitutes the divider between the two individual modules which comprise the furniture, and panels 110 and 111 constitute one side of the work area represented by panel 103. Panel 109 has two protruding ridges, the first perpendicular to the third slot. This first protruding ridge is inserted in the corresponding slot of the panel 104, the second protruding ridge is found in the opposite side of the co-linear slots and is used to receive panel 112 by means of its respective slots. Panel 112, which is rectangular, constitutes the front of the table shared by the individual modules. The position of panel 112 in the modular furniture is vertical and it also has the vertical slot already mentioned, two protruding ridges, one in each side of the shorter sides of the rectangular panel. These two protruding ridges along the edges are inserted through a vertical slot. The panels 112 and 114 form the sides of the table. The structure of the table of the modular furniture is completed through a big horizontal panel, rectangular with only one slot, perpendicular and in the mid section of one of the edges of the longer sides. Panel 115 is inserted through this slot in the second horizontal slot in panel 109, which is found opposite and in a different plane from the first horizontal slot of said panel 109.

The variables which can be extracted from the described modular furniture, with that structural system and assembled as described, are innumberable.

Also, it is feasible to place multiple modular furniture units, as the described, within work areas with many employees or in public places.

The material used for the manufacture of the modular furniture is varied, for example: natural wood, wood by-products, plastics, metals and a combination of these materials. The panels used are those known as "single-face panels" which render an attractive appearance and offer good structural resistance and there are also "double-face panels".

The length, width and height of the panels can vary and there are no limitations in this regard. In the market panels can be found of several lengths and widths.

The novel invention has been described. The following claims are presented:

1. Balanced modular furniture comprising at least two work stations, a first work station for one user and a second work station for a second user, each of said first and second work stations including at least two horizontal panel portions forming two vertically supported working tables having an adjacent side marginal free edge of each of their working surfaces extending generally laterally at right angles to each other so as to include in vertical projection an arc of 90 degrees and to provide a space between said adjacent free edges for each user of the two work stations and of the two working tables for each of two users, the said two work stations include four working tables comprising two sets of two table portions each and wherein the first work station includes a first table portion and a second table portion and the second work station includes a third table portion integral with said first table portion to form a first integral one-piece member but partitioned therefrom by a first vertical partitioning panel member having a slot therein for engaging and joining with an intermediate part of the first integral one-piece member which includes the first table portion and the third table portion, a fourth table portion integral with said second table portion to form a second integral one-piece member but partitioned therefrom by said first vertical partitioning panel which has another slot therein for engaging with an intermediate part of the second integral one-piece member which includes the fourth table portion and the second table portion;

said first vertical partitioning panel member partitioning the first table portion from the third table portion having a side marginal free edge adjacent to a side marginal free edge of the first table portion with the second table portion arranged to extend generally laterally and at right angles to the first table portion and said second table portion is partitioned by said first partitioning panel from the fourth table portion having a side marginal free edge adjacent to a side marginal free edge of the third table portion which is at right angles to the third table portion, a second single vertical panel member spaced from said first and third table portions supporting a margin of said second working table portion and a margin of said fourth table portion, a third vertical panel spaced from said first and second vertical panels supporting said first table portion and a fourth vertical panel spaced from the first, second, and third vertical panels supporting the third table portion, panel members forming a document storage unit, at least one of said single integral vertical panels serving to support said document storage unit above and vertically spaced from a working table portion, a plurality of said panels including said horizontal portions and vertical panels being formed with one or more slots and being assembled with one another as aforesaid by means of said slots which cooperate with surfaces of said panels to effect the joining of said panels into a stable, strong, and balanced structure.

2. Balanced modular furniture in accordance with claim 1 in which the assembly includes four work stations in a stable, strong, and balanced structure and wherein there are four sets of two table portions and wherein an extension of said first vertical partitioning panel member partitions a fifth table portion from a seventh table portion and a sixth table portion having a side marginal free edge adjacent to a side marginal free edge of the fifth table portion which is arranged to extend generally laterally at right angles to said fifth table portion and from an eighth table portion having a side marginal free edge adjacent to a side marginal free edge of the seventh table portion which is arranged to extend generally laterally at right angles to said seventh table portion and wherein a fifth integral vertical panel supports a margin of each of said sixth and eighth table portions and wherein said third vertical panel also supports said fifth table portion and wherein said fourth vertical panel also supports said seventh table portion, and wherein a sixth vertical panel and an extension thereof partition the first table portion from the fifth table portion and partition the third table portion from the seventh table portion.

* * * * *